United States Patent [19]

Stevick

[11] 4,105,544

[45] Aug. 8, 1978

[54] GRAVEL PROCESSING SYSTEM

[76] Inventor: Ronald A. Stevick, 1100 S. Jackson Rd., Cement City, Mich. 49233

[21] Appl. No.: 791,156

[22] Filed: Apr. 26, 1977

[51] Int. Cl.[2] ..... B07B 9/00

[52] U.S. Cl. ..... 209/317; 209/246; 209/257; 209/420

[58] Field of Search ..... 209/420, 421, 244, 246, 209/240, 241, 257, 315, 316, 317, 254, 313; 241/75, 76, 81, 101.7

[56] References Cited

U.S. PATENT DOCUMENTS

| | | | |
|---|---|---|---|
| 1,282,127 | 10/1918 | Richardson | 209/313 X |
| 2,297,486 | 9/1942 | Linke et al. | 209/311 X |
| 2,628,718 | 2/1953 | Dockins | 209/254 X |
| 3,016,203 | 1/1962 | Sears et al. | 209/315 X |
| 3,622,089 | 11/1971 | Quinn | 209/315 X |
| 3,841,570 | 10/1974 | Quinn | 241/101.7 X |

*Primary Examiner*—Frank W. Lutter
*Assistant Examiner*—Ralph J. Hill
*Attorney, Agent, or Firm*—Beaman & Beaman

[57] ABSTRACT

A gravel processing system, preferably of the portable type, utilizing a plurality of screens and conveyors wherein the particle sizes of the finished product may be accurately regulated, and readily varied. Two screen boxes are mounted upon a frame, each box including a plurality of screens which are charged at their inner ends by a top-loading hopper having several outlets providing a versatility of screen charging. The vibrating screens discharge at their outer ends, and the conveyors located below the screens convey the fines from both screen boxes to a common discharge point. A chute and bypass system at the discharge end of one screen box permits the screen discharge to be selectively conveyed to one of several conveyors or chutes, for re-processing or re-crushing, and the apparatus of the system provides extraordinary versatility and particle size sorting and classification in a relatively concise apparatus.

14 Claims, 9 Drawing Figures

GRAVEL PROCESSING SYSTEM

BACKGROUND OF THE INVENTION

The invention pertains to gravel screening, sorting, mixing and conveying apparatus wherein the fines and discharge of vibrating screens may be selectively mixed and conveyed to provide the desired ratio of gravel compositions.

In the processing of pit run gravel it is the conventional practice to process the gravel through crushers, screens and conveyors to achieve the desired percentage of particle sizes in the finished product. The gravel particles are classified by vibrating screens wherein particles incapable of passing through these screens are discharged at a screen end for crushing or storing, and apparatus is available for classifying and separating various gravel sizes for intermixing with other gravel particles to achieve a desired gravel particle size composition in the finished product.

In gravel screening systems a plurality of discharge chutes are often used for classification purposes, such as shown in U.S. Pat. No. 3,425,552. Likewise, the accumulation and intermixing for proportion purposes can be achieved by a plurality of hoppers and accumulation chambers such as shown in U.S. Pat. No. 3,297,159. It is also known to use hopper guide means in conjunction with a plurality of vibrating screens to selectively direct gravel particles to the desired screen or screen box, such as shown in U.S. Pat. No. 3,388,797. However, to the applicants' knowledge, gravel screening apparatus is not available which, in a single apparatus, permits a wide variety of gravel particles to be readily screened, discharged, conveyed to a crusher, stored, proportioned and intermixed in a continuous operation whereby the proportions of gravel particle sizes may be readily varied in the finished product.

Known gravel screening apparatus is not readily available of a concise nature capable of portability wherein a high degree of flexibility of operation and choice of sequences of conveying, mixing, crushing and re-crushing is possible.

SUMMARY OF THE INVENTION

It is an object of the invention to provide a gravel processing system of relatively concise configuration wherein a versatility of operation is achieved to permit a wide variety of screening and conveying functions resulting in a number of optional cycles of gravel particle handling to permit the ratio of particle sizes within the finished product to be accurately regulated and over size particles easily separated.

Another object of the invention is to provide a gravel screening system utilizing a pair of vibrating screen boxes each having a plurality of screens mounted thereon wherein the screens can be selectively or simultaneously charged through a top-loading hopper having controlled outlets directing unscreened gravel to the boxes, the screens having discharges remote from the hopper for loading conveyors leading to rock-crushers or storage piles, and the discharge of the screens of one box being provided with adjustable chutes and bypass structure to permit re-crushing or mixing in order to achieve a desired finished product composition.

In the practice of the invention the gravel processing apparatus is mounted upon a portable frame which may be transported to the site of the gravel supply in the usual manner. The frame is of a elongated configuration having upper and lower regions, opposite ends, lateral sides and a central region. A pair of vibrating screen boxes are mounted upon the frame, each box including several screens therein and the screens having a loading or charging end adjacent the frame central region, and a discharge end adjacent a frame end. Thus, one screen box entends from the central region to one of the frame ends, while the other screen box extends from the central region to adjacent the opposite frame end.

A top-loading hopper is mounted at the central region of the frame above the screen boxes, and includes several outlets having openings which may be closed, partially opened, or fully opened for selectively directing pit run gravel deposited therein to the loading end of the desired screens. One of the boxes contains two screens, while the other box contains three superimposed screens, and a single belt conveyor is mounted below the two-screen box for receiving the fines flowing therethrough. This belt conveyor moves in such direction to convey the fines toward the lower central region of the frame to deposit the fines on an auxiliary conveyor disposed below the hopper.

A belt conveyor is also mounted below the three-screen box, and this conveyor actually consists of two belt conveyors in parallel, side by side, relationship having one end capable of discharging upon the auxiliary conveyor disposed below the hopper, and upon reversing the direction of conveyor movement the conveyor pair may discharge adjacent the associated frame end. The pair of conveyors, together, receive the fines flowing through the three-screen box, and control means in the form of a pair of longitudially aligned vanes are used to regulate the proportion of fines falling upon one conveyor or the other. By running the conveyors of this pair in opposite directions it is also possible to proportion the fines between conveyors, and thereby proportion the fines conveyed to the finished product conveyor below the hopper and the other conveyor of the pair wherein the fines may be discharged adjacent the associated frame end.

Chutes are located at the discharge ends of the screens of the two-screen box, and these chutes normally communicate with a conveyor for transmitting the screen oversized discharge to a conventional rock crusher. The output of the rock crusher is fed upon a conveyor mounted upon a lateral side of the frame for depositing the crushed material upon the upper screen of the three-screen box.

While it is to be appreciated that the screens of the three-screen vibrating box are replacable according to the grid size desired, a discharge arrangement is used with the screens which permits a high degree of versatility of sorting, reworking and conveying. The upper screen of the three-screen box is provided with a discharge which permits the overflow therefrom of oversized gravel particles to be deposited upon a belt conveyor mounted upon a lateral side of the frame for transport to the discharge chute of the upper screen of the two-screen box wherein such gravel particles may be reintroduced into the stone crusher. The second or intermediate screen of the three-screen box is provided with a discharge chute and hopper wherein the overflow discharge may be selectively directed to a chute for discharge upon a storage or piling conveyor, or upon one of the pairs of conveyors mounted below the three-screen box.

The overflow discharge of the third or lower screen of the three-screen box communicates with the same belt conveyor as the upper screen, wherein the discharge thereof is reintroduced into the crusher, and, of course, the fines flowing through the third screen will fall to the pair of belt conveyors located therebelow.

By utilizing screens of desired grid opening sizes, recycling and reworking stone that has been crushed and screened, by forming the finished product from the fines of the two-screen box, and the desired portion of the fines from the three-screen box, it is possible to closely regulate the composition of the finished product so that the composition may vary.

By controlling the direction of movement of the conveyors of the pair below the three-screen box, and by regulating the overflow of the intermediate screen of the three-screen box for selective discharge or transport to the finished product conveyor, an option of operation which significantly increases the flexibility of the apparatus as compared with known gravel processing apparatus, and a greater range of compositions may be achieved in the final product than previously possible.

BRIEF DESCRIPTION OF THE DRAWINGS

The forementioned objects and advantages of the invention that will be appreciated from the following description and accompanying drawings wherein.

DESCRIPTION OF THE PREFERRED EMBODIMENT

Figure 1:
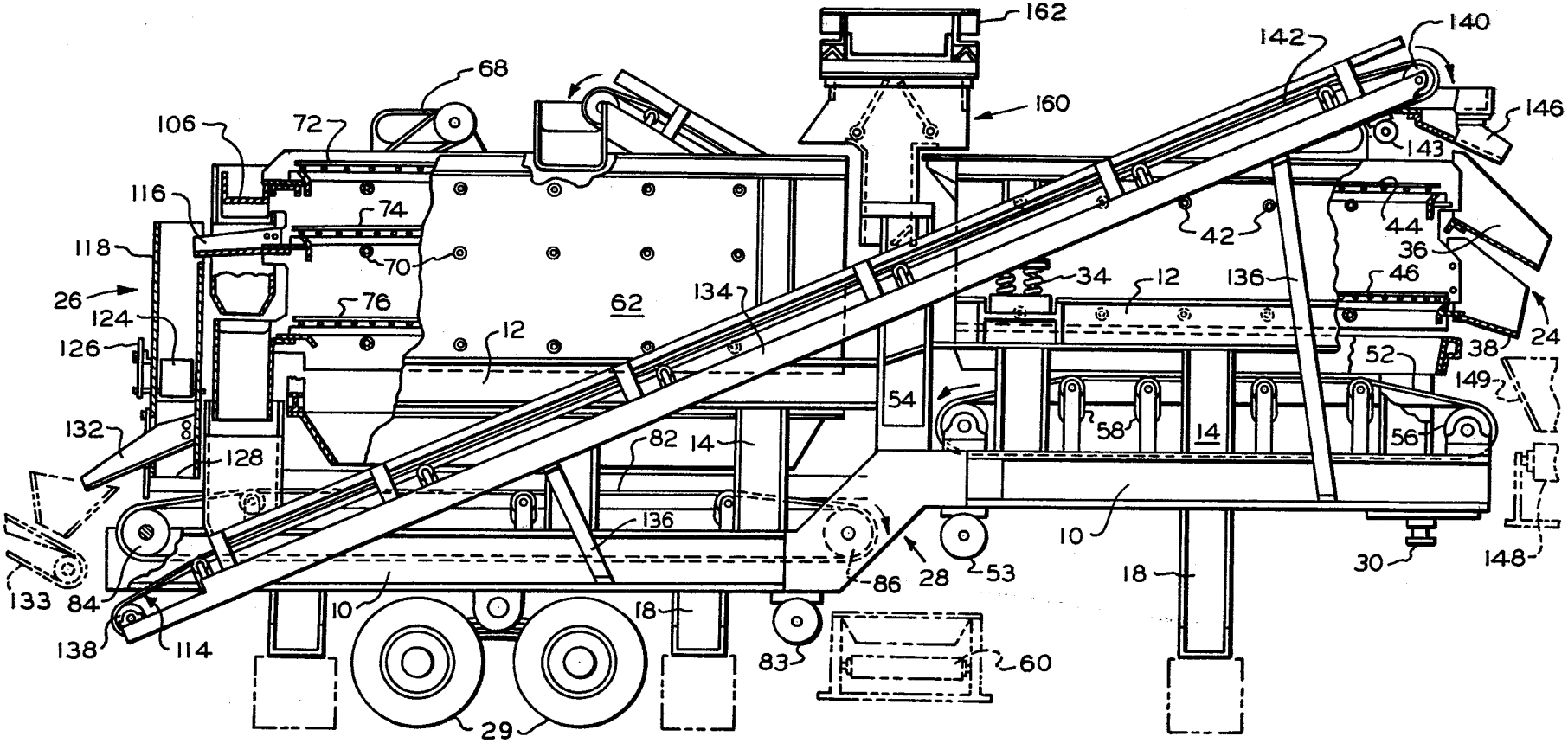
FIG. 1 is an elevational view of one lateral side of gravel processing apparatus in accord with the invention, partially sectioned at the discharge ends of the screen boxes, for the purpose of illustration.
Figure 2:
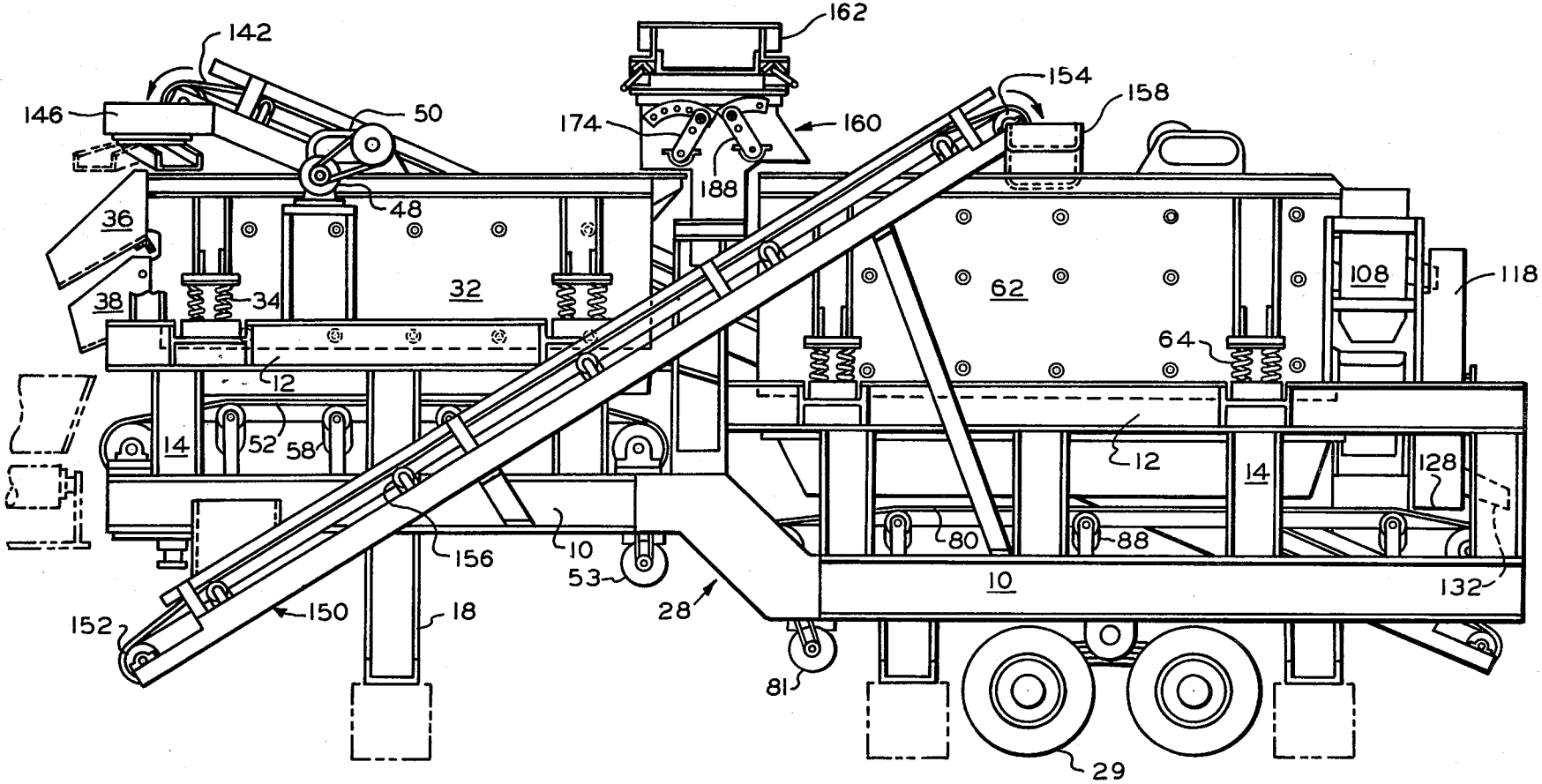
FIG. 2 is elevational view of the opposite side of the gravel processing apparatus in accord with the invention.
Figure 5:
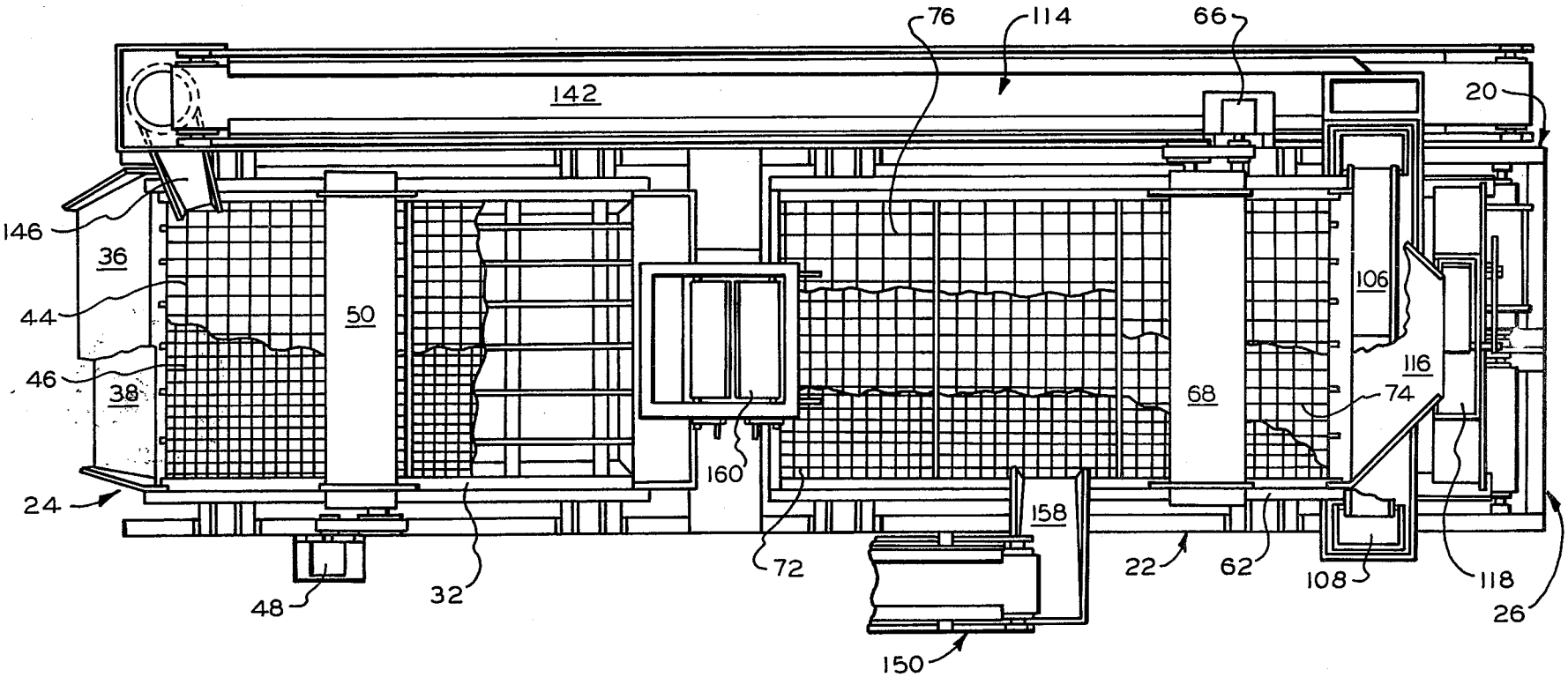
FIG. 5 is a top plan view of the apparatus, portions of the screens and other components being broken away for purpose of illustration.

With reference to FIGS. 1 and 2, it will be appreciated that the gravel processing apparatus of the invention includes a frame having horizontal channel beams 10 and 12 disposed on each of the lateral sides of the frame interconnected by vertical channel elements 14. Horizontal spacer beams 16 extend between beams 10 and bracing and support pads 18 extend downwardly from the frame to rest upon support blocks, and as appreciated from the top view of FIG. 5, the apparatus has a generally rectangular plan configuration.

For general reference purposes, the lateral sides of the frame are generally designated by reference numerals 20 and 22 and the frame includes an end 24, and an opposite end 26. The region indicated by reference numeral 28 is hereinafter designated the central region of the frame as this region is disposed substantially intermediate the ends 24 and 26.

For transporting purposes wheels 29 are mounted to the frame, and a kingpin 30 is attached adjacent the end 24 for connection to a tractor whereby the entire apparatus, once removed from its supporting blocks, maybe readily transported to its site of use.

Figure 6:
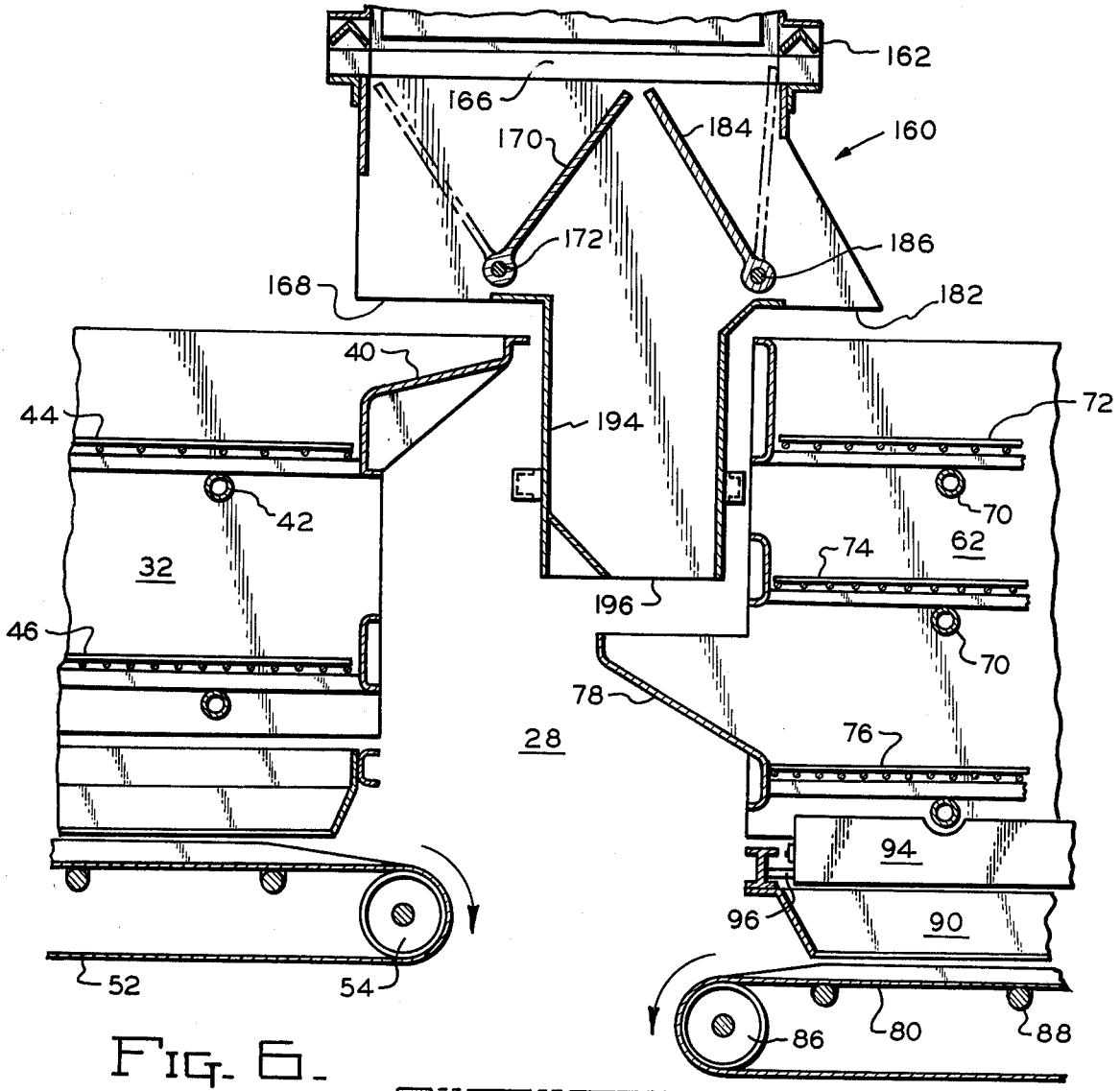
FIG. 6 is an enlarged, detailed, elevational sectional view taken through the central region of the apparatus illustrating the top-loading hopper and loading ends of the screen boxes.

With reference to FIGS. 1 and 2, the vibrating screen box 32 is mounted upon the horizontal frame channels 12 by the usual spring suspension 34. The screen box 32 is of the usual rectangular configuration having closed sides, maintained in spaced relationship by spacer members, and the outer end is open supporting discharge chutes 36 and 38 in vertical superimposed relationship. The inner end of the screen box 32 is shown in FIG. 6, and, at its upper region includes a gravel guide 40 for directing the gravel from the hopper to the upper screen. A plurality of screen supports 42 extend between the box sides for supporting the upper screen 44, and the lower screen 46 directly located below screen 44. Of course, the grid openings of the screen 44 are greater than those of screen 46. As will be appreciated from FIG. 1, the discharge chute 36 is located on the box 32 to receive the oversized particles vibrated across the screen 44 which do not fall therethrough, and in like manner, the discharge chute 38 receives the oversized particles supported upon screen 46.

Vibration of the screen box 32 is produced by electric motor 48 rotating eccentric weights within housing 50 mounted upon the top of the box, and as this structure is of conventional nature it is not described in greater detail. It will be appreciated that the mode of vibration opposed upon the box 32 is such that stones and rocks not passing through the screens move toward the discharge chutes 36 and 38, while the fines will fall through the screen box to the belt conveyor therebelow, as later described.

The belt conveyor 52 mounted upon the frame below the screenbox 32 includes a drive pulley 54, FIG. 1, operatively connected to an electric drive motor 53 and a tail pulley 56. Support rollers 58 located below the belt box shape the belt conveyor to the known trough configuration in order to hold the gravel fines thereon. The belt conveyor 52 travels in the direction of the arrow, FIG. 1, whereby fines deposited thereon are discharged at the central region of the frame and fall to a belt conveyor 60 disposed below the frame central region. The belt conveyor 60 is for the purpose of receiving the finished product, and this belt conveyor communicates with a hopper, of other conveyor, not shown, for transporting the finished product to the desired location.

A second screen box 62 is mounted upon the frame on the other side of the central region 28 by compression springs 64, and the box 62 is vibrated by electric motor 66 rotating eccentric weights within housing 68 mounted upon the box in the usual manner. The box 62 includes closed lateral sides maintained in spaced parallel relationship by spacers and the box is open adjacent the frame end 26 whereby the overflow discharge from the screens may be handled, as later described.

Three screens are mounted upon the screen supports 70 the upper screen 72 usually having the largest grid openings, the intermediate screen 74 having intermediate size grid openings, and the lower screen 76 usually being of the finest grid dimension. The screens may be readily removed from the box 62 for replacement by other screens of different grid size, and the configuration of the inner end of the box will be appreciated from FIG. 6. In particular, it will be noted that a guide chute 78 extends into the central region of the frame whereby gravel may be directly deposited from the hopper onto the lower screen 76, as later explained.

Belt conveyor means are located below the screen box 62, and such means include a pair of identical belt conveyors 80 and 82 located in parallel side-by-side relation. Each conveyor includes an outer end pulley 84, and an inner pulley 86, and the upper portions of the belts are supported intermediate the pulleys by the contoured support rollers 88. The pulleys 84 are located adjacent the frame end while the pulleys 86 are disposed at the frame central region 28, and capable of discharge to the conveyor 60, as will be appreciated from FIGS. 1 and 6. Conveyors 80 and 82 are separately driven by reversible electric motors 81 and 83, respectively.

Figure 3:
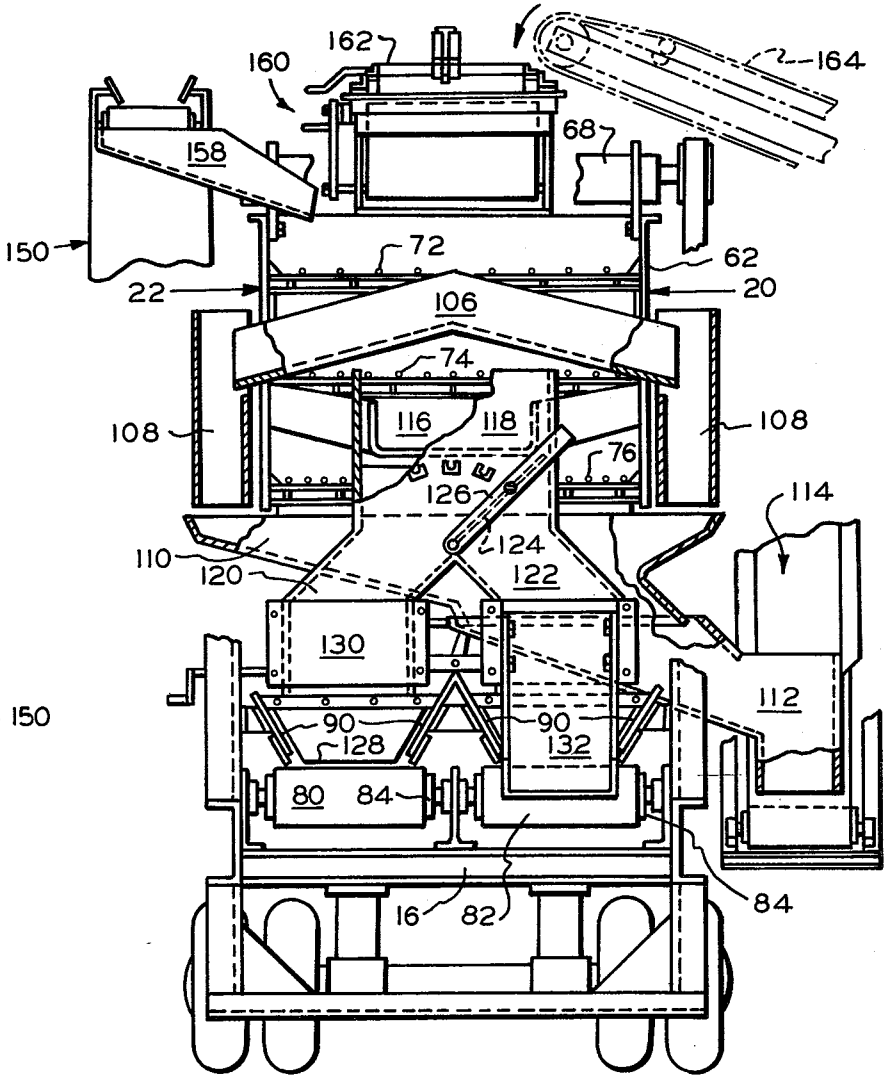
FIG. 3 is an end elevational view of the processing apparatus as taken from the left end of FIG. 1.
Figure 4:
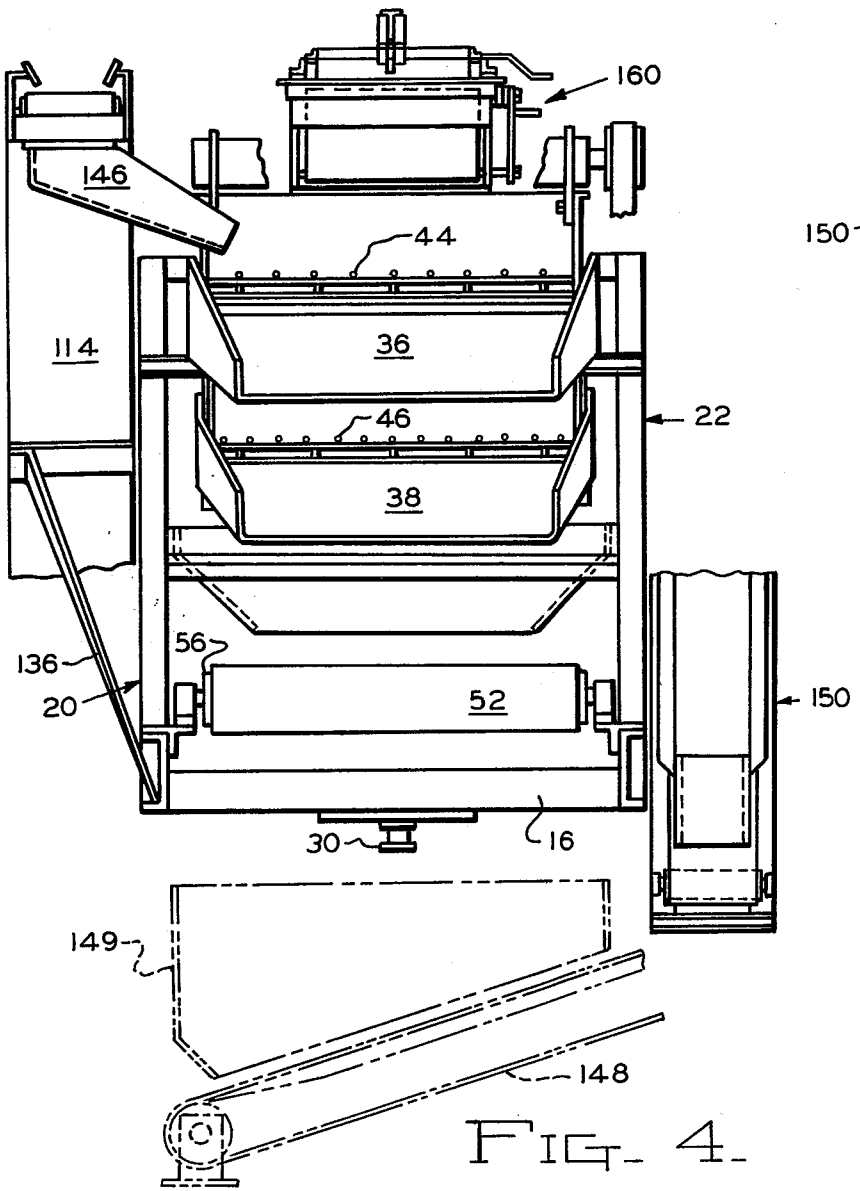
FIG. 4 is an end elevational view as taken from the right end of FIG. 1.
Figure 8:
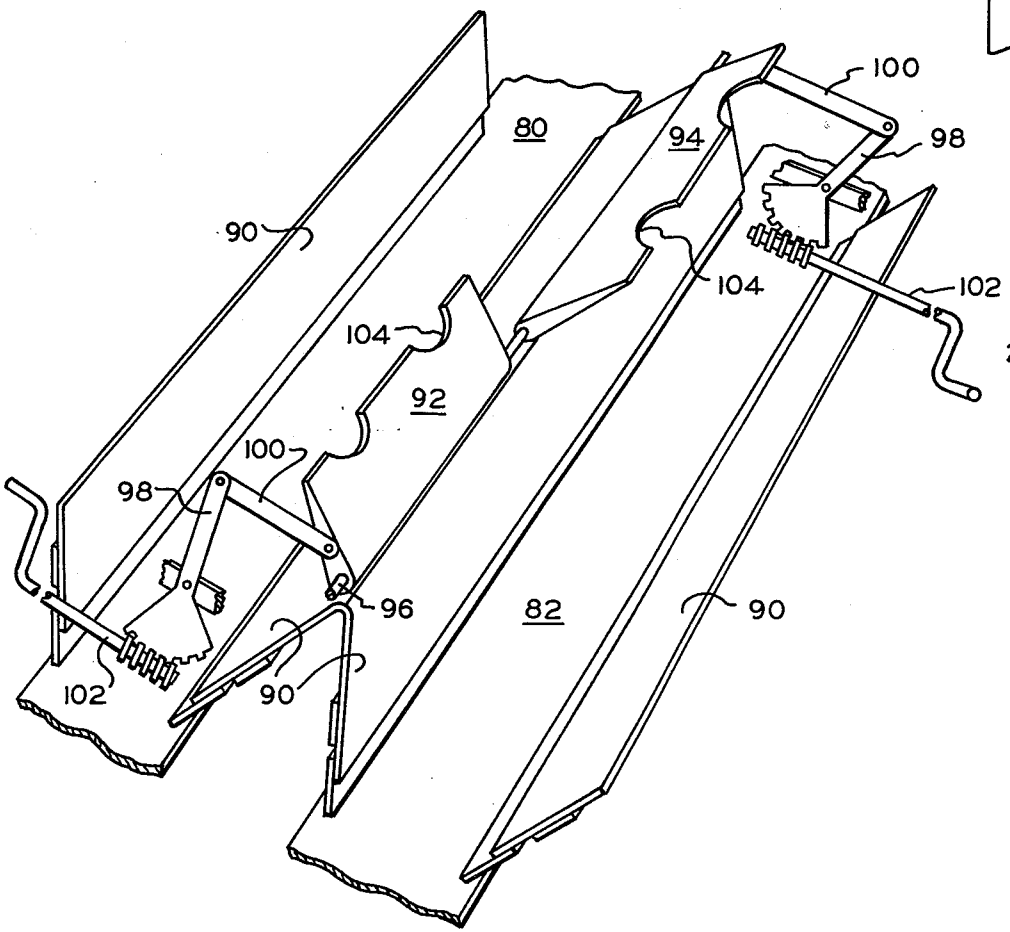
FIG. 8 is a perspective, schematic view of the conveyor pair and dividing vane located below the three-screen box, and, FIG. 9 is an end elevational view similar to FIG. 3 illustrating an embodiment utilizing a belt conveyor to receive screen discharge particles.

As will be noted in FIGS. 3 and 8, diverging guides 90 are located above the belt conveyors 80 and 82. The guides 90 insure that all the fines flowing through screen box 62 will be deposited on the conveyors 80 and 82. However, it is often desired that the percentage of the fines passing through the screens deposited on each conveyor be varied in order to regulate the composition of the finished product. To this end a pair of vane gates, FIG. 8, are mounted intermediate the conveyors 80 and 82. Each gate 92 and 94 is pivoted about an axis 96 and is controlled by a bell lever 98 and link 100. The lever 98 is pivoted by a worm drive controlled by crank 102, and notches 104 formed in the gate provide clearance of the screen supports 70. By rotating cranks 102 the angular relationship of a gate to its axis 96 can be changed and, as the gates can be adjusted to extend over the conveyors 80 and 82 to variable degrees, the amount of fines deposited on one conveyor or the other can be varied. By using two gates the versatility and degree of composition regulation is increased as compared to using only a single gate.

The outer end of the screen box 62 is provided with a network of chutes and guideways for directing the overflow discharge of the screens 72, 74 and 76 in order to provide a flexibility of classification and separation of the oversize particles. An inverted V-shaped chute 106 mounted upon the box 62 receives the over-sized particles from the outer end of the screen 72 whereby such particles may be directed toward the lateral sides of the frame and fail to one or the other of vertical chutes 108 which are open at the bottom to the guide chute 110 which communicates with the lateral chute 112 for conveying to the recrushing conveyor 114 mounted upon the frame side 20.

A discharge chute 116 is mounted to the outer end of the screen box 62 for receiving the oversized particles from the intermediate screen 74. The chute 116 empties into the hopper 118 mounted upon the frame end 26, and the hopper 118 supplies parallel chutes 120 and 122 wherein flow therethrough is controlled by the vane 124 affixed to exteriorly accessible handle 126. The outlets 128 of the chutes 120 and 122 are disposed above the belt conveyors 80 and 82, respectively. The chutes also each include a removable closure plate 130 wherein removal thereof permits the insertion of a small bypass chute 132, FIG. 1, which extends to the associated chute rear wall such that all particles falling within the chute will engage the chute and be conveyed beyond the frame end 26 into a separately supported conveyor 133 rather than fall to a conveyor 80 or 82 through outlet 128. It is to be understood that the chute 132 may be mounted in either of the chutes 120 or 122 upon removal of a closure plate 130 and that the use of the chute 132 will depend on the sizes of the particles to be screened and separated, and the composition of the final product deposited on conveyor 60.

The discharge of the oversized particles from screen 76 fall into the chute 110 for conveying to the recrushing conveyor 114 and, thus, it will be appreciated that both the oversized particles from the upper screen 72 and the lower screen 76 will be transported to the conveyor 114, while the oversized particles of the intermediate screen 74 will fall into the hopper 118 for selective flow into chute 120, or chute 122, and the destination thereafter will be determined by the presence or absence of the bypass chute 132.

The recrushing conveyor 114 is best shown in FIG. 1 wherein the conveyor includes an elongated frame 134 mounted upon the frame lateral side 20 by bracing elements 136. The conveyor includes a lower tail pulley 138, and an upper drive pulley 140 for supporting the belt 142. Pulley 140 is driven by electric motor 143. Intermediate the upper and lower pulleys a plurality of supporting rollers 144 support the lower side of the upper belt portion in a concave configuration whereby the oversized rock and gravel particles received thereon from screens 72 and 76 will be maintained upon the conveyor and lifted to a discharge chute 146 horizontally rotatable wherein the chute may discharge onto the screen 44, or may discharge onto the chute 36.

The chutes 36 and 38 discharge onto a belt conveyor 148 through hopper 149, FIGS. 1 and 2, for conveying the rocks deposited thereon to a rock crusher, preferably of the rotating type. This rock crusher is not shown, but may be of any conventional nature, and forms no part of the present invention. The output from the rock crusher supplied by the conveyor 148 is deposited upon a belt conveyor 150 mounted upon the frame lateral side 22, FIG. 2. The conveyor 150 includes a tail pulley 152, and an upper pulley 154, and the belt is supported upon its upper under side by a plurality of guide rollers 156 which form a concave supporting surface for the crushed material discharged by the crusher.

The conveyor 150 discharges into a chute 158 located above the upper edge of the screenbox 62 approximately centrally located on the box whereby the crushed particles are deposited on screen 72 for flow therethrough, or discharge of the oversized particles onto the chute 106 for recycling through the crusher.

Figure 7:
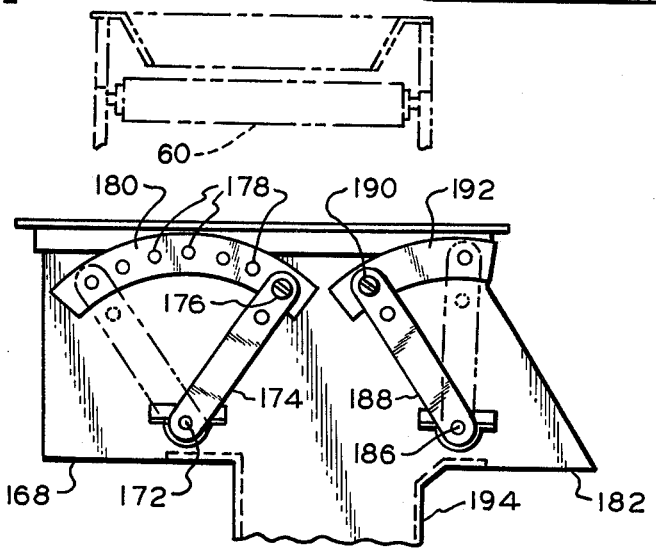
FIG. 7 is an enlarged, detail, elevational view of the control lever mechanism for the hopper.

The apparatus of the invention is charged through a top loading hopper 160 mounted upon the central region 28 of the frame intermediate the screen boxes 32 and 62, as will be appreciated from the drawings. The hopper 160 includes a cap member 162 through which the pit run gravel, or preliminarily crushed gravel, may be introduced by a belt conveyor 164, FIG. 3. The hopper 160 has a single upper inlet 166, but has three outlets. The outlet 168 is defined above the screen gravel guide 40, and flow through this outlet is controlled by a vane 170 mounted upon a shaft 172 extending across the hopper. The rotation of the shaft 172, and position of the vane 170, is controlled by a lever 174 having a locating pin 176 selectively received in a plurality of positioning holes 178 formed in positioning segment 180. Thus, it will be appreciated that the position of the vane 170 may be adjusted between the extremes shown in full and dotted lines in FIG. 6. In FIG. 6 the maximum flow of gravel into the screen box 32 is achieved when the vane is in the full line position. When the lever 174 is rotated counterclockwise to the dotted line position of FIG. 7 the vane 170 closes the outlet 168 completely.

The hopper 160 also includes an outlet 182 disposed over the inner end of the screen 72, and gravel flow through this outlet is controlled by vane 184 pivotal between the full line open position of FIG. 6, and the closed dotted line position. The vane 184 is pivotally mounted upon the hopper 160 by shaft 186, and the position of the shaft and vane is controlled by lever 188 having a locating pin 190 therein which cooperates with holes within the segment 192 for selective adjustment between the two positions illustrated.

The hopper 160 also includes a downwardly extending extension 194 having an open end constituting the third hopper outlet 196. The outlet 196 is disposed directly above the guide chute 78 of screenbox 62 wherein all gravel flowing from the outlet 196 is deposited upon the lower most screen 76.

With reference to FIG. 6, when the vanes 170 and 184 are in the positions shown in full lines the majority of the gravel being introduced into the hopper 160 by the conveyor 164, approximately two-thirds thereof, will be directed upon the upper screen 44, while approximately one-third of the gravel will be engaging the vane 184 and be directed through outlet 182 upon the screen 72. There will be no gravel flow through the outlet 196 in view of the fact that the upper ends of the vanes 170 and 184 are disposed adjacent each other and prevent gravel flow to the hopper extension 194.

If vane 170 is maintained in the full line position of FIG. 6, and the vane 184 is rotated clockwise to its closed dotted line position, approximately two-thirds of the gravel introduced into the hopper will be deposited upon the upper screen 44, and the remaining one-third will flow through outlet 196 onto the screen 76.

If the vane 170 is pivoted to its closed dotted line there will be no gravel flow to the screen 44, and two-thirds of the gravel will flow through the extension 194 onto screen 76, and one-third onto screen 72 if vane 184 is open, or all of the flow will be to screen 76 if outlet 182 is closed by vane 184.

In that the vane positioning segment 180 includes a plurality of locating holes 178 for the lever 174, the vane 170 may be accurately proportioned between its fully open and closed positions, and the portion of gravel entering the hopper 160 being deposited upon screen 44 may be varied from zero to two-thirds, the remainder of the gravel being deposited upon screens 72 or 76, depending upon the position of the vane 184.

From the above description with respect to the hopper operation, it will be appreciated that the position of the vanes 170 and 184 permits a wide degree of adjustment between the amounts of gravel to be deposited on the screens of the screenboxes 32 and 62.

The rocks and stones incapable of passing through the screens 44 and 46 flow across to the screens to the chutes 36 and 38 and fall onto the conveyor 148 for conveying to the rock crusher. Likewise, the oversized stones and rocks moving across screens 72 and 76 are deposited on the chute 106, or chute 110, respectively, and are shunted to the conveyor 114 whereby they are also deposited upon the chute 36 for introduction into the rock crusher. Thus, all of the oversized particles received on screens 44, 72 and 76 will be processed through the rock crusher.

As described above, the output from the rock crusher is fed upon the conveyor 150 and thereby deposited upon the screen 72. Accordingly, much of this crushed product will flow through screen 72 onto screens 74 and 76, and in the event that it does not flow through screen 74 it will be fed to the hopper 118 for selective discharge for stacking and storage purposes by means of chute 132 and conveyor 133, or a portion of these larger particles may be deposited on one of the belts 80 or 82 and mixed with the finished product being deposited upon conveyor 60.

The fines flowing through screenboxes 32 and 62 will fall to the belt conveyors 62, 80 and 82. Thus, those fines which pass through these screens will not pass through the crusher, or be conveyed by conveyors 114 or 150, but quickly pass to conveyor 60 for removal from the apparatus or a portion of fines can be removed by a conveyor 80 or 82 if the direction of travel is toward end 26. When the pit run gravel has a high initial percentage of fines the hopper vanes may be adjusted to substantially evenly divide the flow of gravel into the hopper between the screenboxes 32 and 62 to minimize overloading due to the heavy percentage of fines, but if fines are to be removed from the finished product a high percentage of the gravel will be directed to screen 76 through outlet 196.

The grid size of screen 76 is normally larger than that of screen 74, and thus screen 76 will usually determine the largest sizes of the gravel particles which will be permitted in the finished product deposited on conveyor 60. By positioning the vane 184 the proportion of the particles deposited on screen 76 may be varied as desired.

The electrical motors driving the belt conveyors 80 and 82 are reversible in direction whereby the belt conveyors may selectively and individually move in a direction to deposit fines flowing through the screens of box 62 toward the finished product conveyor 60, or a conveyor 80 or 82 may be reversed in its direction of movement to convey the material thereon toward the frame end 26. In such instance, a conveyor, similar to 133, would have to be located adjacent the frame end 26 to receive the material from the reversed conveyor for stacking purposes. This versatility in the direction of movement of the conveyors 80 and 82 makes it possible to separate the fines flowing through box 62, and thereby regulate the percentage of fines deposited on conveyor 60.

The control of the percentage of fines within the finished product is also accomplished through the use of the vane gates 92 and 94. By operation of the cranks 102 the angle of inclination of the gates 92 and 94 to the vertical can be regulated, and the greater the angle of the gates from the vertical, the greater will be the amount of fines deflected toward a conveyor 80 or 82. With reference to FIG. 8, if the gates 92 and 94 are both pivoted counterclockwise to their maximum extent to the left the gates will cause approximately seventy percent of the fines flowing through box 62 to be deposited on conveyor 82, the remainder of the fines being received by conveyor 80. By regulating the direction of movement of the conveyors 80 and 82 the fines received on these conveyors can be selectively conveyed to the finished product conveyor 60, or to the frame end 26 for storage elsewhere. By utilizing a pair of vane gates 92 and 94 the amount of fines flowing through box 62 deposited on either conveyor 80 or 82 can be very closely regulated, and the vane gates, in conjunction with the reversible conveyors associated therewith permits very close control of the amount of fines transported to conveyor 60.

Normally, the conveyor 52 will move in the direction to deposit the fines received thereon flowing through box 32 to conveyor 60, and by positioning the vanes 170 and 184 the amount of pit run gravel being divided between screenboxes 32 and 62 can be so proportioned that the desired composition of the finished product is readily achieved.

The location of the screen boxes 32 and 62 on opposite sides of the central region 28, and the location of the hopper 160 at the central region having one outlet to the screens of box 32, and two outlets to the screens of box 62, in conjunction with the distribution of gravel flowing through the hopper as provided by vanes 170 and 184, permits a wide variety of gravel proportions to be distributed between the screens, and this versatility of control permits the apparatus to be readily adapted to operate at full capacity regardless of the composition of the pit run gravel stock. For instance, where the pit run gravel contains a high percentage of fines the gravel flowing through the hopper 160 can be substantially evenly divided between the two screenboxes to prevent overloading of the screens. Where the pit run gravel contains a higher percentage of large rocks and stones a higher percentage of the gravel may be fed to the box 32 wherein the large particles will be quickly conveyed to the rock crusher prior to being re-screened.

The utilization of the vane gates 92 and 94 in conjunction with the pair of conveyors 80 and 82 further provides a degree of control not achievable with prior gravel processing apparatus, and the reversible movement of the conveyors 80 and 82, in conjunction with the determination of the proportion of the fines flowing through box 62 which are deposited upon each conveyor, permits a close regulation of the percentage of fines flowing through box 62 which are deposited on the finished product conveyor 60.

Figure 9:
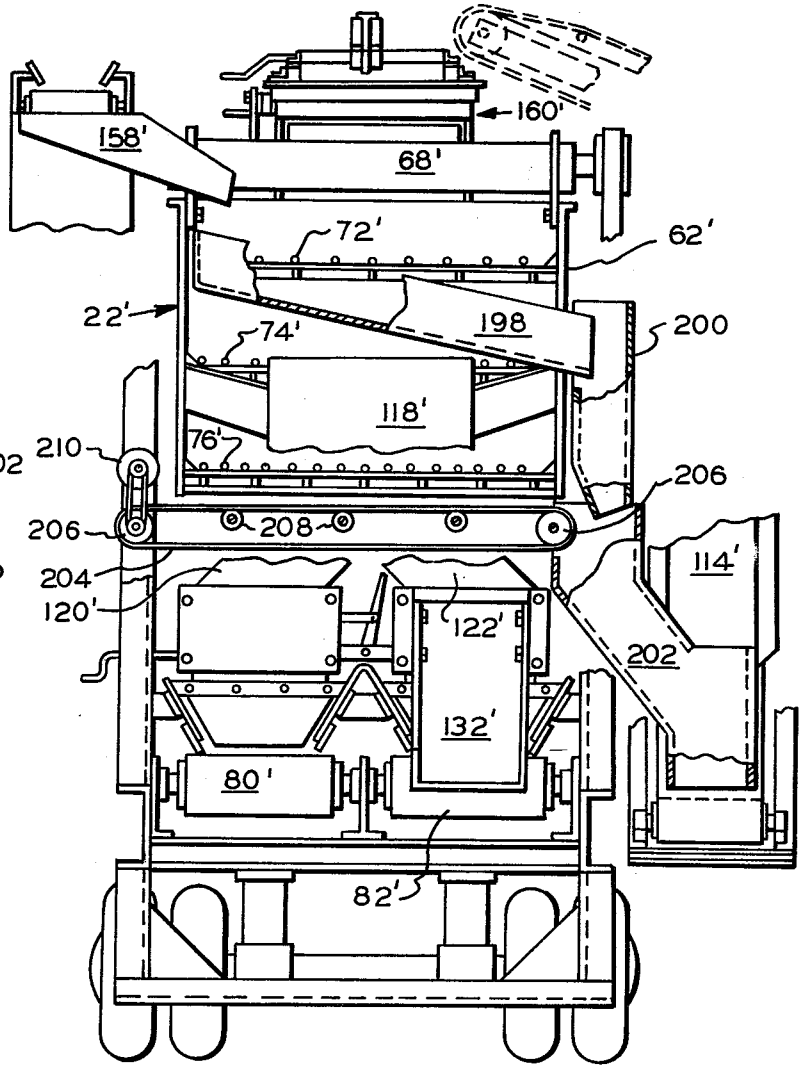

In FIG. 9 a variation in the handling of the oversize particles of the upper and lower screens of the three-screen box is shown. Components of this embodiment similar to those previously described are indicated by primed reference numerals.

In the embodiment of FIG. 9 the structure differs from that previously described in the means for handling the overflow discharge from the upper screen 72' and the lower screen 76'. A chute 198 receives the overflow from the upper screen 72', and this chute discharges into the vertical guide 200 which empties into the lower lateral chute 202 supplying the conveyor 114'. Thus, all the overflow from upper screen 72' will be deposited on chute 198 and on conveyor 114', as in the previously described embodiment, except that a divided flow from the screen 72' is not utilized.

The overflow discharge from the end of the screen 76' is upon a powered belt conveyor 204 mounted upon the frame end 26 "behind" the hopper 118'. The belt conveyor 204 includes end rollers 206 rotatably mounted upon frame and support rollers 208 supporting the upper portion of the belt receiving the discharge from screen 76'. The conveyor belt 204 is driven by a reversible electric motor 210. As viewed in FIG. 9, the right end of the belt conveyor is located within the guide chute 202 such that clockwise rotation of the rollers 206 will feed the discharge of screen 76' into the chute 202 and onto conveyor 114'. The drive means for the conveyor 204, as shown, is reversible and the reversing of the direction of rotation of the rollers 206 will cause the over flow discharge from screen 76' to move to the left and be discharged from the lateral side 22' of the frame adjacent the frame end. An auxiliary conveyor, not shown, is located adjacent the frame end below the left roller 206 to receive this discharge from the conveyor 204 whereby the grade of gravel being discharged from the end of lower screen 76', rather than being recycled through the crusher, as in the aforedescribed embodiment, may be separated from the apparatus and piled or transported away. Thus, it will be appreciated that the conveyor 204 imparts an added versatility to the basic apparatus of the invention permitting an additional grade of gravel to be separated.

It will be appreciated that the apparatus of the invention permits a wide variety of sizes of gravel to be processed in a relatively concise mechanism. The location of the two screen boxes on the frame as initially supplied from a common hopper, the ability of the fines to be discharged at the central region of the frame, the control of the composition as provided by the vanes 92 and 94 and the conveyors 80 and 82, and the bidirectional operation of these conveyors, permit the operator to screen, sort, crush and separate a wide variety of gravel particle sizes with a minimum of adjustment and "down time".

It is appreciated that various modifications may be apparent to those skilled in the art without departing from the spirit and scope of the invention.

I claim:

1. A gravel processing apparatus for screening and separating gravel comprising, in combination, a frame having a top, bottom, first and second ends, first and second lateral sides and a vertically extending central region, a first vibrating screen mounted on said frame located between said lateral sides, central region and first end, a second vibrating screen mounted on said frame located between said lateral sides, central region and second end, motor means mounted on said frame drivingly connected to said screens for producing vibration thereof, a top loading hopper mounted on said frame at said central region having an upper inlet and first and second outlets vertically located below said inlet, said first outlet selectively communicating with said first screen adjacent said central region and said second outlet selectively communicating with said second screen adjacent said central region, adjustable flow control means within said hopper selectively controlling flow through said outlets, said first screen having an oversize particle discharge adjacent said first end, said second screen having an oversize particle discharge adjacent said second end, a first conveyor mounted on said frame below said first screen receiving the gravel passing therethrough, a second conveyor mounted on said frame below said second screen receiving the gravel flowing therethrough, drive means mounted on said frame selectively driving said conveyors whereby ungraded gravel introduced into said hopper inlet may be selectively introduced onto said screens and graded gravel removed from said discharges and from said conveyors, said first screen including a first vibratory box resiliently supported on said frame, said second screen including a second vibratory box resiliently mounted upon said frame, said first and second conveyors being mounted below said first and second boxes, respectively, a third screen mounted on said first box directly below said first screen, a fourth screen mounted on said second box directly below said second screen, said first and second conveyors being below said third and fourth screens, respectively, said third screen having an oversize particle discharge adjacent and below said first screen discharge, and said fourth screen having an oversize particle discharge adjacent and below said second screen discharge.

2. In gravel processing apparatus as in claim 1, a discharge chute and hopper communicating with said fourth screen discharge having first and second outlets and an adjustable deflector selectively directing gravel flowing into said discharge chute and hopper into its first and second outlets.

3. In gravel processing apparatus as in claim 2, a third conveyor mounted on said frame adjacent a lateral side thereof having a lower loading end adjacent said frame bottom and second end and an upper discharge end adjacent said frame top and first end for discharging into said first screen discharge, said second screen discharge communicating with said third conveyor loading end.

4. In gravel processing apparatus as in claim 1, a fifth screen mounted on said second box directly below said fourth screen, said second conveyor being below said fifth screen, a third outlet defined in said hopper below said said second outlet communicating with said fifth screen, said flow control means selectively controlling gravel flow through said hopper second and third outlets, said fifth screen having an oversize particle discharge located below said discharge for said second and fourth screens.

5. In gravel processing apparatus as in claim 1, wherein said second conveyor comprises a pair of parallel belt conveyors mounted in side-by-side relation on said frame below said second screen extending between said frame second end and central region, said conveyor drive means being capable of driving said pair of belt conveyors individually and in either direction of movement.

6. A gravel processing apparatus for screening and separating gravel comprising, in combination, a frame, first and second vibrating screen boxes mounted on said frame each having an open bottom, a first grading screen mounted in said first box having a discharge end and a loading end, a second grading screen mounted in said second box having a discharge end and a loading end, motor means mounted on said frame vibrating said boxes in a direction to translate oversize particles across said screens to said discharge ends, a hopper mounted on said frame vertically above said screens having an inlet, a first outlet communicating with said first screen loading end and a second outlet communicating with said second screen loading end, flow control means within said hopper regulating flow through said outlets, a first belt conveyor mounted on said frame below said first box bottom receiving fines flowing through said first screen and discharging at a first location, a second belt conveyor mounted on said frame below said second box bottom receiving fines flowing through said second screen selectively discharging at said first location, drive means mounted on said frame drivingly associated with said conveyors, a third screen mounted on said second box below said second screen having a discharge end adjacent and below said second screen discharge end and a loading end adjacent and below said second screen loading end, and a third outlet defined in said hopper communicating with said third screen loading end, said flow control means regulating flow through said third outlet.

7. In gravel processing apparatus as in claim 6 wherein said second conveyor comprises a pair of parallel belt conveyors, separate drive means drivingly associated with said pair of conveyors for selectively driving each in either direction, and adjustable flow control means mounted on said frame above said pair of conveyors capable of varying the proportion of fines sifting through said second box between said pair of conveyors.

8. In gravel processing apparatus as in claim 6, a fourth screen mounted on said second box intermediate said second and third screens having a discharge end adjacent and below said second screen discharge end, a second hopper mounted on said frame communicating with said fourth screen discharge end having a pair of outlets, flow control means within said second hopper selectively directing flow to one of said pair of outlets, said pair of outlets selectively communicating with said second conveyor.

9. A gravel processing apparatus for screening and separating gravel comprising, in combination, a frame having a central region and first and second ends, a first vibratory screen box having an open bottom mounted on said frame having a loading end located at said central region and a screen discharge end adjacent said frame first end, a first screen mounted on said first box, a second vibratory screen box having an open bottom mounted on said frame having a loading end located at said central region and a screen discharge end adjacent said frame second end, a second screen mounted on second box, a first belt conveyor mounted on said frame disposed below said first box receiving the fines flowing therethrough having a discharge end at said frame central region, a first motor mounted on said frame driving said first belt conveyor, second and third belt conveyors mounted on said frame below said second box receiving the fines flowing therethrough, said second and third conveyors being substantially parallel and each having an end at said frame central region and an end adjacent said frame second end, second and third motors mounted in said frame drivingly connected to said second and third conveyors, respectively, for selectively driving said conveyors in either direction, adjustable flow control means mounted on said frame above said second and third conveyors selectively proportionately dividing the fines flowing through said second box between said second and third conveyors, a hopper mounted on said frame at said central region having an inlet above said screen boxes loading ends, a first outlet communicating with said first box loading end and a second outlet communicating with said second box loading end, and adjustable flow control means within said hopper selectively controlling flow through said outlets.

10. In gravel processing apparatus as in claim 9, a third screen mounted on said second box below said second screen, a third outlet defined in said hopper communicating directly with third screen, said flow control means regulating flow through said third outlet, a fourth belt conveyor mounted on said frame having a loading end adjacent said frame second end receiving the discharge from said third screen and an unloading end discharging upon said first screen adjacent said frame first end, and a fourth motor mounted on said frame driving said fourth conveyor.

11. In gravel processing apparatus as in claim 10, a chute mounted on said frame receiving the discharge from said second screen, said chute communicating with said fourth conveyor loading end.

12. In a gravel processing apparatus as in claim 10, a fifth belt conveyor mounted upon said frame second end transversely disposed across said second end having first and second discharge ends located adjacent opposite lateral sides of said frame, said fifth belt conveyor receiving the oversize particle discharge of said third screen, said first discharge end communicating with said fourth belt conveyor and said second discharge end adapted to discharge particles on said fifth conveyor laterally of said frame, and reversible drive means selectively driving said fifth belt conveyor in either direction of movement to selectively discharge said fifth conveyor from either discharge end.

13. In gravel processing apparatus as in claim 9, a fourth screen mounted on said second box intermediate said second and third screens, a second hopper mounted on said frame receiving the discharge from said fourth screen and having a pair of outlets, one of said outlets selectively communicating with said second conveyor and the other outlet selectively communicating with said third conveyor, and flow control means within said second hopper selectively directing flow to one of said second hopper outlets.

14. In gravel processing apparatus as in claim 13, a by-pass chute within one of said second hopper outlets preventing flow from said second hopper through the associated outlet from being directed to said second or third conveyors.

* * * * *